United States Patent [19]

Jacobs et al.

[11] Patent Number: 5,038,495

[45] Date of Patent: Aug. 13, 1991

[54] DEVICE FOR COOLING A WEB OF MATERIAL COMING OUT OF A DRIER

[75] Inventors: Thomas G. M. Jacobs, Cuijk; Clemens J. M. de Vroome, Beugen, both of Netherlands

[73] Assignee: Stork Contiweb B.V., Netherlands

[21] Appl. No.: 514,188

[22] Filed: Apr. 25, 1990

[30] Foreign Application Priority Data

Apr. 26, 1989 [NL] Netherlands ..... 8901052

[51] Int. Cl.[5] ..... F26B 19/00

[52] U.S. Cl. ..... 34/62; 34/155; 34/156; 34/92

[58] Field of Search ..... 34/155, 156, 160, 62, 34/67, 92, 16

[56] References Cited

U.S. PATENT DOCUMENTS

| | | | |
|---|---|---|---|
| 2,571,815 | 10/1951 | Benoit et al. | 34/18 |
| 3,293,775 | 12/1966 | Kitrosser | 34/156 |
| 3,324,570 | 6/1967 | Flaith et al. | 34/156 |
| 3,496,648 | 2/1970 | Hering, Jr. | 34/156 |
| 4,112,587 | 9/1978 | Sundman | 34/62 |
| 4,406,388 | 9/1983 | Takashi et al. | 34/156 |
| 4,622,761 | 11/1986 | Barth | 34/160 |
| 4,652,278 | 3/1987 | Oliker | 34/62 |

FOREIGN PATENT DOCUMENTS

| | | |
|---|---|---|
| 177774 | 4/1986 | European Pat. Off. . |
| 2465175 | 3/1981 | France . |
| 348760 | 5/1931 | United Kingdom . |

OTHER PUBLICATIONS

O. D. Johnson and C. Holovka, Jr., "Web Cooling Apparatus", Oct. 1960.

*Primary Examiner*—Henry A. Bennet
*Assistant Examiner*—Denise L. F. Gromada
*Attorney, Agent, or Firm*—Ostrolenk, Faber, Gerb & Soffen

[57] ABSTRACT

A cooling device for cooling a web of material coming out of a drier, in particular a paper web of an offset printing machine coming out of a drier, which cooling device comprises a substantially closed housing with an inlet and an outlet slit for the web of material, said housing being provided at the outlet slit side with a feed aperture for feeding in outside air and at the inlet slit side with a discharge aperture for discharging air from the housing, the air being fed through the housing in counterflow to the direction of movement of the web of material, wherein the housing in the direction of movement of the web of material is provided with two or more cooling units placed in series which bring the infed air successively into contact with the web of material.

4 Claims, 1 Drawing Sheet

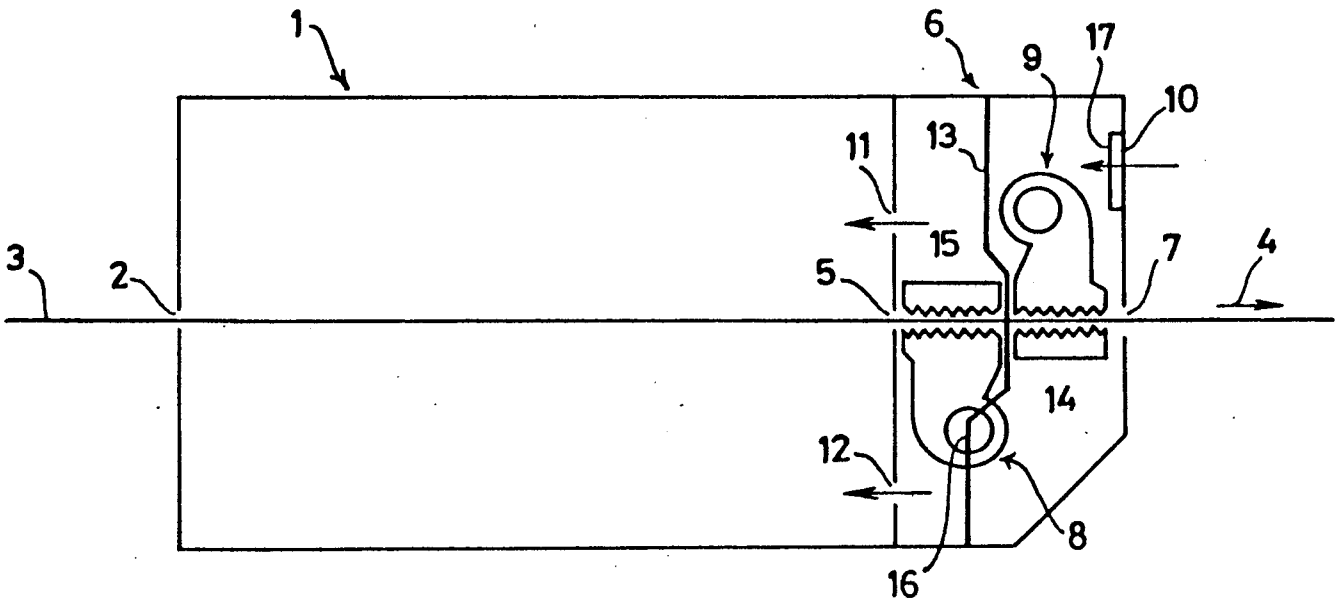
1
2
3
4
5
6
7
8
9
10
11
12
13
14
15
16
17

DEVICE FOR COOLING A WEB OF MATERIAL COMING OUT OF A DRIER

BACKGROUND OF THE INVENTION

This invention relates to a device for cooling a web of material coming out of a drier, in particular a paper web of an offset printing machine coming out of a drier, which cooling device comprises a substantially closed housing with an inlet and an outlet slit for the web of material, said housing being provided at the outlet slit side with a feed aperture for feeding in outside air and at the inlet slit side with a discharge aperture for discharging air from the housing, the air being fed through the housing in counterflow to the direction of movement of the web of material.

DISCUSSION OF THE PRIOR ART

In an offset printing machine in particular, the paper web is heated up in the drier, so that the printing ink applied to the paper web evaporates. On leaving the drier, the paper web is conveyed over cooling rollers and is then reeled. When the paper web leaves the drier it is at a temperature of, for example, 130° C., at which temperature some further evaporation still takes place, and the boundary layer of the paper web still contains oil-containing vapours. These vapours surrounding the paper web condense on the cooling rollers, on which a film can form that after some time becomes so thick that the ink soils the paper web and stains thus occur through smearing of the ink. In order to prevent this, the printing machine must always be stopped after some time has elapsed, in order to clean the cooling rollers.

In the past, attempts were made to solve this problem by blowing cold air on the web of material at the outlet of the drier, with the object of blowing away the boundary layer before it reaches the cooling roller.

Another solution to the problem is cleaning the cooling rollers during operation, for example by means of a cleaning roller. None of these existing solutions has, however, produced the desired result in practice.

SUMMARY OF THE INVENTION

The object of the invention is then to produce a device for cooling a web of material coming out of a drier, in which the temperature of the web is reduced in such a way that virtually no further evaporation occurs when the web of material arrives at the cooling rollers.

This object is attained by the invention in that the housing in the direction of movement of the web of material is provided with two or more cooling units placed in series which bring the infed air successively into contact with the web of material.

In this way ambient air at about 20° C. is used for cooling the web of material. Due to the fact that the infed cooling air flows counter to the direction of movement of the web of material, the cooling air is heated up and will consequently be able to absorb an increasing quantity of the solvent coming from the web of material.

The air thus heated up and discharged from the housing can particularly expediently be fed into the drier.

Driers generally require a supply of fresh air which serves as combustion air for the burners present in the drier and to compensate for the flue gases discharged, so that a certain partial vacuum is maintained in the drier. When outside air at ambient temperature is fed into the warm interior of the drier, there is always the risk of condensation forming, in the form of mist which can settle on the fixed parts of the drier and can give rise to pollution. Using air which is already heated prevents the risk of condensation in the drier and also increases the energy efficiency of the drier.

According to the invention, each unit for bringing air into contact with the web of material comprises a fan whose outlet side is coupled to a group of spray nozzles situated on either side of the web of material.

Alternatively, each unit for bringing air into contact with the web of material comprises two or more fans whose outlet sides are coupled to a group of spray nozzles situated on one side of the web of material.

The construction of the cooling device effects that the outside air enters the cooling device at the side where the web of material leaves the cooling device. The incoming air mixes with the atmosphere present in the cooling device and is drawn in by the fan of the unit which is adjacent to the outlet slit of the cooling device, which unit sprays the mixture through the spray nozzles onto the web. The air leaving this unit is then drawn in by the fan of the adjacent unit, so that the temperature of the air sprayed onto the material web increases in the direction counter to the direction of movement of the web of material. Due to the fact that the outside air is first mixed with the atmosphere present in the cooling device, this outside air is slightly preheated, so that the spray nozzles do not cool down to such an extent that condensation settles on them.

In order to make good use of the heat drawn from the web of material, according to the invention the discharge aperture is connected to the interior of the drier.

The claims and advantages will be more readily appreciated as the same becomes better understood by reference to the following detailed description and considered in connection with the accompanying drawing.

DESCRIPTION OF THE PREFERRED EMBODIMENT

The drawing shows a schematically indicated drier 1 which can be of any suitable type, into which a web of material 3 is fed through an inlet slit 2. The web of material moves in the direction of the arrow 4, and leaves the drier 1 at the outlet slit 5.

Connected to the drier 1 is a cooling device 6, which in the present case is fixed to the drier, so that the outlet slit 5 of the drier coincides with the inlet slit of the cooling device. The web of material leaves the cooling device through an outlet slit 7.

The cooling device contains two units 8 and 9 which are adjacent to each other, viewed in the direction of movement of the web of material, and each of which comprises a group of spray nozzles lying on either side, that is, top and bottom of the web of material and a fan connected thereto.

The two units are separated from each other by means of a partition 13, which divides the interior of the cooling device 6 into two compartments 14, 15. The partition 13 has a slit-shaped aperture for the passage of the web of material 3 and an aperture 16 for the passage of air from the compartment 14 to the compartment 15.

The suction nozzle of the fan of the unit 8 in the compartment 15 is placed in such a way that air is drawn in both from the compartment 14 and from the compartment 15. This is indicated schematically in the drawing by having the suction nozzle of the fan of the unit 8 open partially into the compartment 14.

As is usual in driers, the web of material is conveyed in the cooling device floating between the spray nozzles.

At the side of the outlet slit 7 the housing of the cooling device is provided with a feed aperture 10 for feeding in outside air, while at the opposite side of the cooling device discharge apertures 11 and 12 are provided for discharging air form the cooling device.

The operation of the cooling device shall now be described. The web of material 3, which can be, for example, a paper web printed by an offset printing machine, is fed into the drier 1, which is not a part of the invention and will not be described in detail here. What is important, however, is that the paper web leaves the drier 1 at a temperature of, for example, 130° C. The paper web then passes through the cooling device 6, and leaves the cooling device at a temperature of, for example, 90° C., following which the web is guided over cooling rollers (not shown) and is then reeled.

The object of the cooling device is in the first place to lower the temperature of the paper web from, for example, 130° C. to, for example, 90° C., at which temperature the rate of evaporation is so low that little or no further condensation takes place at the cooling rollers.

The outside air is admitted to the cooling device through the aperture 10, and this air mixes to some extent with the atmosphere in the compartment 14 before being drawn in by the fan of the unit 9. The outside air thus heated is sprayed through the spray nozzles of the unit 9 on either side onto the paper web 3. The air coming out of the spray nozzles is then drawn in by the fan of the unit 8 and mixed with the air present in the compartment 15, and is subsequently sprayed through the spray nozzles of said unit on either side against the paper web 3. The air coming out of the spray nozzles of the unit 8 is then discharged through the apertures 11 and 12. It will be clear that the temperature of the air sprayed by the unit 9 onto the paper web is lower than the temperature of the air sprayed by the unit 8 onto the web. In fact, the air admitted through the aperture 10 is heated up in counterflow to the direction of movement of the web.

In the example shown the web is cooled in two stages, but it will be clear to the expert that the number of stages can be increased as desired by fitting a larger number of units in different compartments adjacent to each other in the cooling device.

The air discharged from the cooling device through the apertures 11 and 12 can advantageously be used as feed air for the drier. This has the advantage for the drier that this air heated up to, for example, 70° C. cannot cause any condensation problems inside the drier. Besides, the energy efficiency of the drier is increased due to the fact that a part of the heat stored in the material web is fed back to the drier.

The quantity of outside air admitted to the cooling device through the apertures 10 is regulated by a valve 17 disposed in said aperture, in such a way that a constant partial vacuum is maintained in the cooling device.

A further advantage of the cooling device according to the invention is that an after-drying effect also occurs in this cooling device, which means that the actual drier can be made smaller in dimensions.

What is claimed is:

1. A device for cooling a web of material exiting from a drier and for absorbing solvents coming off the web, the device comprising:

a drier for the web of material;

a substantially closed housing having a web inlet side with an inlet slit formed therein for inlet of the web to the housing from the drier through the inlet slit, and having an outlet side with an outlet slit formed therein for outlet of the web from the housing through the outlet slit, the outlet slit being spaced from the inlet slit;

a feed aperture at the outlet side of the housing for feeding in outside air; a discharge aperture at the inlet side of the housing and communicating into the drier for discharging air from the housing into the drier;

at least one partition in the interior of the housing and placed for dividing the housing into a first compartment toward the inlet slit and a second compartment toward the outlet slit; the partition having a passage slit defined through it for the passage of the web of material from the first to the second compartments and having a passage aperture defined through it for conveying air through the partition from the second to the first compartments in a direction counter to the direction of movement of the web of material;

a respective web cooling and solvent evaporating unit in each compartment for blowing the air feed into the respective compartment into contact with the web of material, the cooling and evaporating unit comprising a fan having an outlet side and a group of spray nozzles connected with the outlet side of the fan and the spray nozzles having respective outlets aimed toward at least one side of the web of material, whereby the fan blows air through the spray nozzles on the one side of material; the fan being positioned in the compartment for circulating air therein, the fan in the first compartment being so positioned and having an inlet that is so positioned as to partly draw in air from the second compartment through the air passage aperture and for the second compartment at the outlet slit, the respective fan and the fan inlet being so positioned as to partly draw air in through the feed aperture for feeding in outside air to the second compartment;

whereby the cooling air moving counter to the direction of movement of the web of material from compartment to compartment cools the web and is correspondingly heated by the web and evaporates solvent from the web and is heated in successive compartments for enabling the progressively warmer air moving from compartment to compartment to hold more evaporated solvent.

2. The cooling and evaporating device of claim 1, further comprising a controllable valve at the feed aperture for feeding in outside air to the second compartment for maintaining a constant partial vacuum inside the housing.

3. The cooling and evaporating device of claim 1, wherein the spray nozzles are situated and have respective outlets aimed toward both sides of the web of material, whereby air is sprayed in the compartment at both sides of the web.

4. A device for cooling a web of material exiting from a drier and for absorbing solvents coming off the web, the device comprising:

a drier for the web of material;

a substantially closed housing having a web inlet side with an inlet slit formed therein for inlet of the web to the housing from the drier through the inlet slit, and having an outlet side with an outlet slit formed therein for outlet of the web from the housing through the outlet slit, the outlet slit being spaced from the inlet slit;

a feed aperture at the outlet side of the housing for feeding in outside air; a discharge aperture at the inlet side of the housing and communicating into the drier for discharging air from the housing into the drier;

at least one partition in the interior of the housing and placed for dividing the housing into a first compartment toward the inlet slit and a second compartment toward the outlet slit; the partition having a passage slit defined through it for the passage of the web of material from the first to the second compartments and having a passage aperture defined through it for conveying air through the partition from the second to the first compartments in a direction counter to the direction of movement of the web of material;

a respective web cooling and solvent evaporating unit in each compartment for blowing the air fed into the respective compartments into contact with the web of material, the cooling and evaporating unit having an outlet aimed toward at least one side of the web of material;

the cooling and evaporating unit being positioned in the compartment for circulating air therein, the cooling and evaporating unit in the first compartment being so positioned and having an inlet that is so positioned as to partly draw in air from the second compartment through the air passage aperture; and for the second compartment at the outlet slit, the respective cooling and evaporating unit and the inlet thereof being so positioned as to partly draw air in through the feed aperture for feeding in outside air to the second compartment;

whereby the cooling air moving counter to the direction of movement of the web of material from compartment to compartment cools the web and is correspondingly heated by the web and evaporates solvent from the web and is heated in successive compartments for enabling the progressively warmer air moving from compartment to compartment to hold more evaporated solvent.

* * * * *